US006237293B1

(12) United States Patent
Gembala

(10) Patent No.: US 6,237,293 B1
(45) Date of Patent: May 29, 2001

(54) ALTERNATIVE BLOCKING FOR ROOF SYSTEMS

(76) Inventor: Henry Gembala, 18108 Clearbrook Cir., Boca Raton, FL (US) 33498

( * ) Notice: Subject to any disclaimer, the term of this patent is extended or adjusted under 35 U.S.C. 154(b) by 0 days.

(21) Appl. No.: 09/177,846

(22) Filed: Oct. 22, 1998

(51) Int. Cl.[7] ..... E04B 1/70

(52) U.S. Cl. ..... 52/302.6; 52/62; 52/96; 52/573.1

(58) Field of Search ..... 52/302.1, 302.6, 52/302.3, 101, 102, 96, 58, 573.1, 300, 62

(56) References Cited

U.S. PATENT DOCUMENTS 2,787,156 * 4/1957 Goodwin .
3,343,323 * 9/1967 Mayfield .
5,272,846 * 12/1993 Kelley et al. ..... 52/96
5,303,523 * 4/1994 Hand et al. ..... 52/101
5,815,986 * 10/1998 Laska ..... 52/62
5,918,427 * 7/1999 Vander Werf ..... 52/100

* cited by examiner

*Primary Examiner*—Carl D. Friedman
*Assistant Examiner*—Yvonne M. Horton
(74) *Attorney, Agent, or Firm*—Robert M. Downey, P.A.

(57) ABSTRACT

The blocking assembly includes one or more pre-formed component structures fabricated from a non-corrosive, durable material, each of the component structures including an anchoring flange for attachment to the roof structure, an upper flange defining a mounting base for attachment of various roofing components, materials and/or equipment thereto, and an intermediate portion between the anchoring flange and the upper flange creating depth therebetween to accommodate insulation or lightweight concrete. The intermediate portion is provided with vent holes for venting gases and moisture which accumulate within the roof structure, thereby reducing the likelihood of premature roof failure.

13 Claims, 5 Drawing Sheets

ALTERNATIVE BLOCKING FOR ROOF SYSTEMS

BACKGROUND OF THE INVENTION

1. Field of the Invention

The present invention relates to blocking for use in roof systems and, more particularly, to a roof blocking system comprising one or more pre-formed, uniform component structures fabricated from a non-corrosive, durable material, such as galvanized steel, steel, aluminum or plastic and including a lower anchoring flange for attachment to the roof structure, a central portion including vent means formed therein, and an upper flange defining a mounting surface for attachment to various roof components and equipment thereto.

2. Description of the Related Art

Generally, roof systems used on most building structures, and particularly commercial buildings, require some type of blocking to provide a base for the attachment of roofing components such as, but not limited to, gravel stops, eves drips, fascia, gutters, vent stacks, roof top equipment, expansion joints, roof curbs, copings and cant strips. Traditionally, wood is used for roof blocking and typically consists of one or more stacked wood boards (e.g., 2 inch by 4 inch or 2 inch by 6 inch boards) which are nailed to the roof structure and each other to provide a buildup base at various locations on the roof system wherein it is necessary to mount the roofing components and equipment. Presently, wood blocking is used on virtually all roof systems which require blocking for the purposes described above.

Despite its widespread use in roof systems, there are significant drawbacks and shortcomings associated with the use of conventional wood blocking. In particular, wood is susceptible to damage and deterioration from moisture, termites, ants and other natural enemies. Further, because wood is a solid material, it does not provide for venting capabilities to permit escape of moisture and gases from within the roof. The lack of adequate venting is a contributing factor of premature roof failure. Additionally, wood has limited pull-out characteristics for holding nails and other fasteners, thereby requiring a considerable amount of hardware to attach roofing components. Wood, being a natural product, is also prone to irregularities such as areas of reduced dimension, warping, and splintering. This makes it difficult, if not impossible, to achieve a straight, uniform blocking configuration. Furthermore, the dimensions of wood are limited to lumber industry standards which often does not correspond to the dimensions of roofing components, such as roof insulation or lightweight concrete thickness, expansion joint heights and equipment sizes.

In view of the shortcomings of traditional wood blocking used in roof systems, as set forth above, there exists an urgent need in the construction industry for an alternative blocking structure which overcomes the above-described problems. More specifically, there is a need for a blocking assembly which provides for uniform dimensions in accordance with desired size and configuration specifications and which further provides for venting of the roof system. Additionally, there is a need for a roof blocking system which significantly reduces costs for labor and materials associated with the installation of blocking and the attached roofing components.

SUMMARY OF THE INVENTION

The present invention is directed to a blocking assembly for roof systems and replaces traditional wood blocking which is currently used on building structures to facilitate the attachment of various roofing components, materials and equipment including, but not limited to, gravel stops, eves drips, fascia, gutters, vent stacks, roof top equipment, expansion joints (flat type, curb type, or curb to wall), copings and cant strips.

The blocking system includes one or more components which are pre-formed in accordance with desired sized and shape specifications. The components, fabricated from galvanized steel, steel, aluminum, plastic or other non-corrosive, durable materials, each include an anchoring flange, an upper flange and intermediate portion. The anchoring flange is structured and disposed for mating attachment to the roof structure underlying an insulation layer or lightweight concrete layer on the roof system. The intermediate portion extends upwardly from the anchoring flange to the upper flange, forming a gap or area of depth for accommodating insulation or lightweight concrete therebetween. The upper flange extends from the intermediate portion and defines a mounting base for attachment of the various roofing components, materials and/or equipment thereto. Vent means are provided in the intermediate portion to allow escape of moisture and gases which otherwise remain trapped within the roof system. This helps to reduce the likelihood of premature roof failure, and thereby extends the life of the roof system.

OBJECTS AND ADVANTAGES OF THE INVENTION

With the foregoing in mind, the present invention has the following objects and advantages over the conventional wood blocking structure presently used in most roof systems.

In particular, a primary object of the present invention is to provide a blocking assembly for roof systems comprising one or more pre-formed components manufactured from galvanized steel, steel, aluminum, plastic or other corrosion resistant materials to thereby provide resistance to deterioration from moisture, insects, warping, and the like.

It is a further object of the present invention to provide a blocking assembly comprising one or more components which are formed and/or molded in accordance with desired size and configuration specifications for use at specific locations of a roof system.

It is still a further object of the present invention to provide a blocking assembly having a pullout resistance which is significantly greater than that of wood, thereby requiring less hardware, labor and materials to install the blocking and attached roofing materials.

It is yet a further object of the present invention to provide a blocking assembly which is pre-formed and fabricated to conform to any roof insulation or lightweight concrete thickness requirements.

It is still a further object of the present invention to provide a blocking assembly for roof systems which includes venting means for allowing moisture and gases to be released from the roof assembly, thereby reducing the likelihood of premature roof failure.

It is still a further object of the present invention to provide a blocking assembly for roof systems which is structured to encapsulate the edge of insulation and/or lightweight concrete, thereby enhancing wind resistance at the roof perimeter.

It is yet a further object of the present invention to provide a blocking assembly having pre-punched fastener holes to thereby alleviate human error during installation.

It is still a further object of the present invention to provide a blocking assembly for roof systems which, once installed, becomes integrated with the roof structure.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
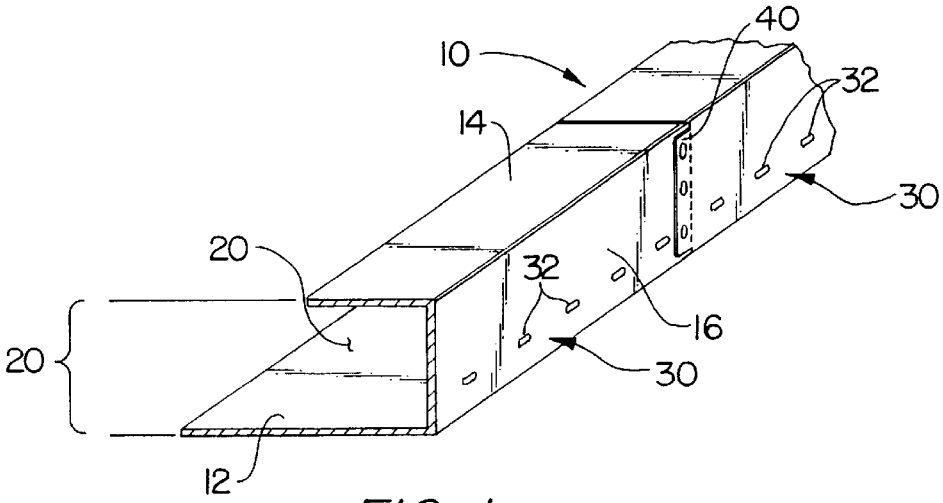
FIG. 1 is a partial perspective view of a first preferred embodiment of the invention showing an edge closure including vent holes and a splice joint to accommodate lateral movement and extension of the edge closure.

FIGS. 1–17 illustrate various exemplary embodiments of a blocking assembly for use on roof systems in order to encapsulate the edge of roof insulation or lightweight concrete and to further provide a means for attaching various roofing components, materials, and equipment thereto. Throughout the several figures of the drawings, the blocking assembly is shown to embody various structures including edge closures, perimeter closures, expansion joint curbs, equipment supports and wall closures. In each of these embodiments, the blocking assembly is generally indicated as 10. It should be noted that the present invention is applicable in building construction configurations other than those shown for purposes of illustration in the drawings, and is generally intended to replace conventional wood blocking at all locations wherein it is necessary to provide a built-up base for the attachment of roofing components, materials and equipment including, but not limited to, gravel stops, eves drips, fascia, gutters, vent stacks, roof top equipment, expansion joints (flat type, curb type, or curb to wall), copings and cant strips.

Figure 2:
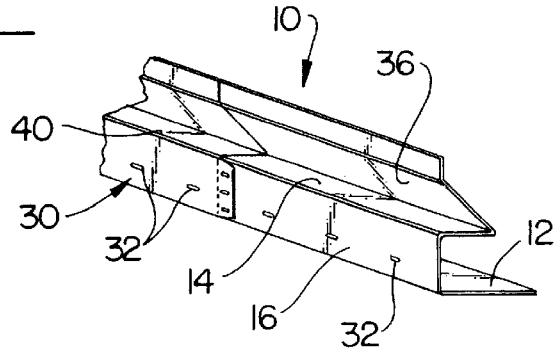
FIG. 2 is a partial perspective view of an edge closure, in accordance with an alternative embodiment of FIG. 1, wherein the edge closure includes a cant extending from the upper flange.
Figure 3:
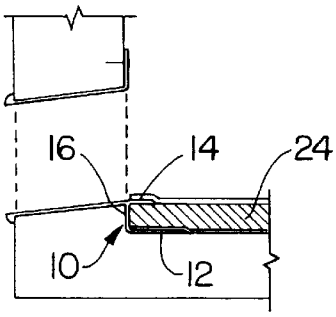
FIG. 3 is a sectional view showing the edge closure of FIG. 1 fitted to a wall scupper of a roof system.
Figure 4:
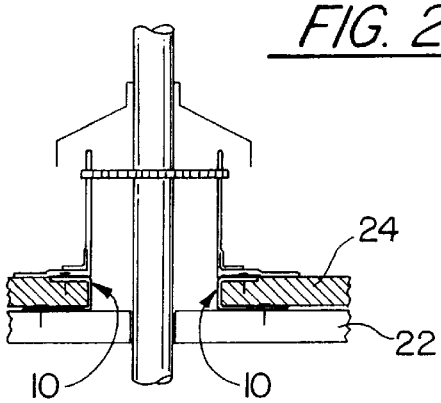
FIG. 4 is a sectional view showing a pair of the edge closures of FIG. 1 used for attachment of a stack slashing on a roof system.
Figure 5:
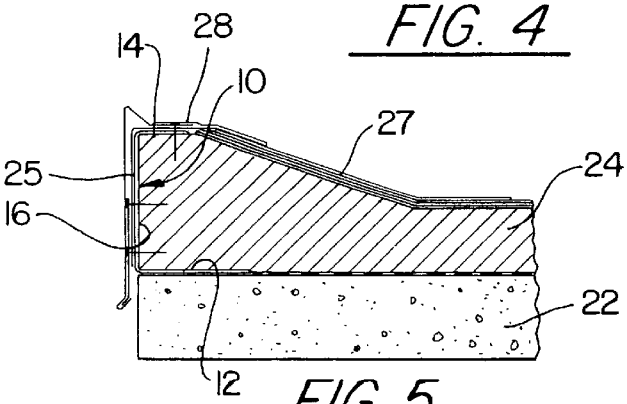
FIG. 5 is a sectional view showing the edge closure of FIG. 1 used for attachment of an eves drip and slashing along the perimeter of a roof system and encapsulating the roof insulation.
Figure 6:
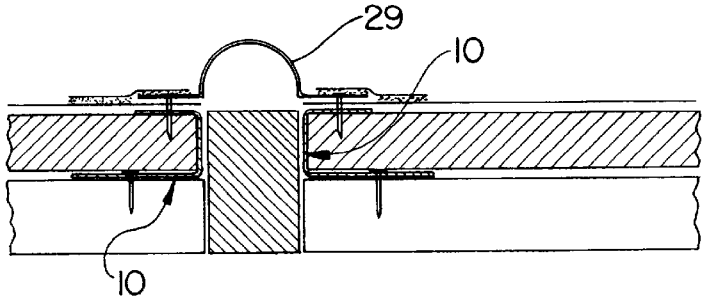
FIG. 6 is a sectional view showing a pair of the edge closures of FIG. 1 used for the attachment of an expansion joint cover at an expansion joint of a roof system.
Figure 7:
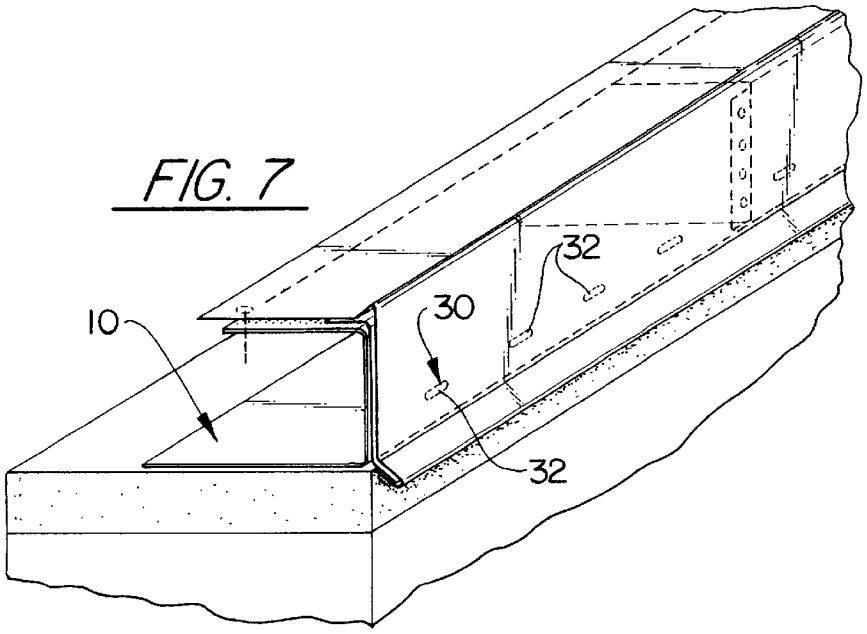
FIG. 7 is a perspective view of the edge closure of FIG. 1 shown being used for the attachment of a gravel stop and cleat.

In FIGS. 1–9, several preferred embodiments of the blocking assembly 10 are shown, wherein the blocking assembly 10 is directed to various perimeter and/or edge closures. The edge and/or perimeter closure is formed as an integral unit and comprises an anchoring flange 12, an upper flange 14, and an intermediate plate 16 extending between the anchoring flange 12 and upper flange 14. The anchoring flange 12 and upper flange 14 extend generally perpendicularly from the intermediate plate in spaced, parallel relation to one another to form a gap or area of depth 20 therebetween. The anchoring flange 12 preferably extends further from the intermediate plate than the upper flange, providing a larger surface area for mating, anchoring attachment to the roof structure. In use, the anchoring flange 12 is attached to the roof slab 22, which is typically a concrete substrate. A drive anchor with removable pin may be used to secure the anchoring flange to the roof slab. Alternatively, concrete nails or other well known anchoring hardware may be used for this purpose. The gap or area of depth 20 accommodates roof insulation or a lightweight insulative concrete layer 24 which is applied in covering relation to the underlying roof slab 22. Various conventional roofing materials, components and equipment may then be secured to the perimeter and/or edge closure 10 using conventional fasteners. For instance, FIG. 4 illustrates the blocking assembly 10 as an edge closure, for mounting a stack flashing to the roof. FIG. 3 shows the blocking assembly 10 in the form of an edge closure for facilitating attachment of a wall scupper. FIGS. 5 and 7 show the blocking assembly 10 in the form of a perimeter closure to facilitate attachment of fascia 25, flashing 27, and a drip 28 to the roof system. FIG. 6 shows the blocking assembly 10 in the form of edge closures for attaching an expansion joint cover 29 at an expansion joint of the roof system.

In each of the above described embodiments, as well as those which follow, the blocking assembly 10 is further provided with vent means 30 for allowing moisture and gases to be released from the roof assembly. In particular, the vent means 30 allow moisture and gases which may accumulate during the installation and setting of lightweight insulation concrete or other insulative material. The release of gases and moisture via the vent means serves to reduce the likelihood of premature roof failure. In the various embodiments shown throughout the drawings, the vent means comprises a plurality of apertures 32 formed through the thickness of intermediate plate portion 16 at spaced intervals along a length thereof. The apertures may be in the form of circular holes or elongate slots.

FIG. 2 illustrates an alternative embodiment of an edge closure of the roof blocking assembly 10, wherein the edge closure includes an integral cant 36 extending from the upper flange 16. FIGS. 1 and 2 further illustrate a splice joint 40 which permits for lateral movement and extension of adjacent sections of the edge closure.

Figure 8:
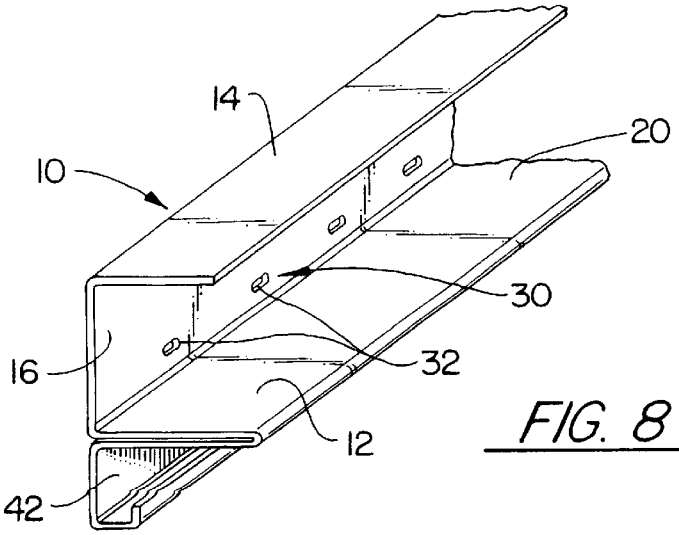
FIG. 8 is a partial perspective view of another embodiment of the invention showing a perimeter edge closure.
Figure 9:
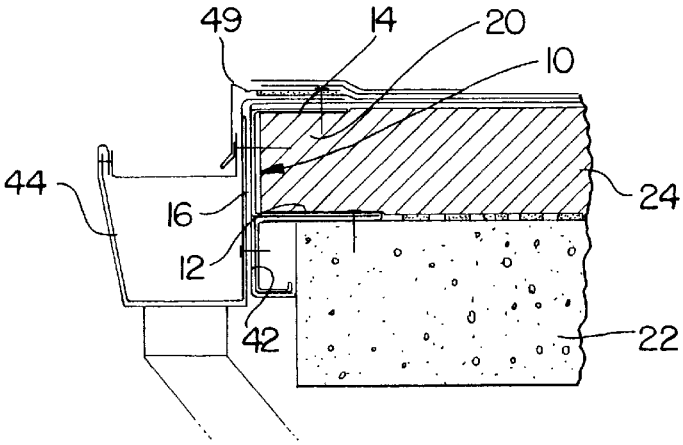
FIG. 9 is a sectional view showing the perimeter edge closure of FIG. 8 installed on the perimeter of a roof system for the attachment of a gutter and flashing strip.

FIGS. 8 and 9 illustrate another embodiment of the blocking assembly 10, wherein the blocking assembly comprises a perimeter and/or edge closure having a fascia portion 42 integral with anchoring flange and extending downwardly therefrom. This particular embodiment of the blocking assembly 10 is suited for installing a gutter 44 along the outer perimeter of a roof, as seen in FIG. 9. Similar to the embodiments described above, the perimeter and/or edge closure of FIGS. 8 and 9 includes the anchoring flange 12, the upper flange 14, and the intermediate plate portion 16 with venting means 30 formed therein. The anchoring flange is secured to the roof structure 22 by conventional fasteners (e.g., drive anchors and removable pins). The gap or area of depth 20 is intended to accommodate a layer of thickness of lightweight insulation concrete material 24 or other insulative material therein, between the anchoring flange and upper flange, as seen in FIG. 9. A roof membrane system 46 or other roof covering material are then applied to the insulation layer and a flashing strip 48 is attached in overlying relation to the juncture of the membrane and upper flange 14. A steel drip edge 49 may further be attached, between the flashing and upper flange of the perimeter closure.

Figure 10:
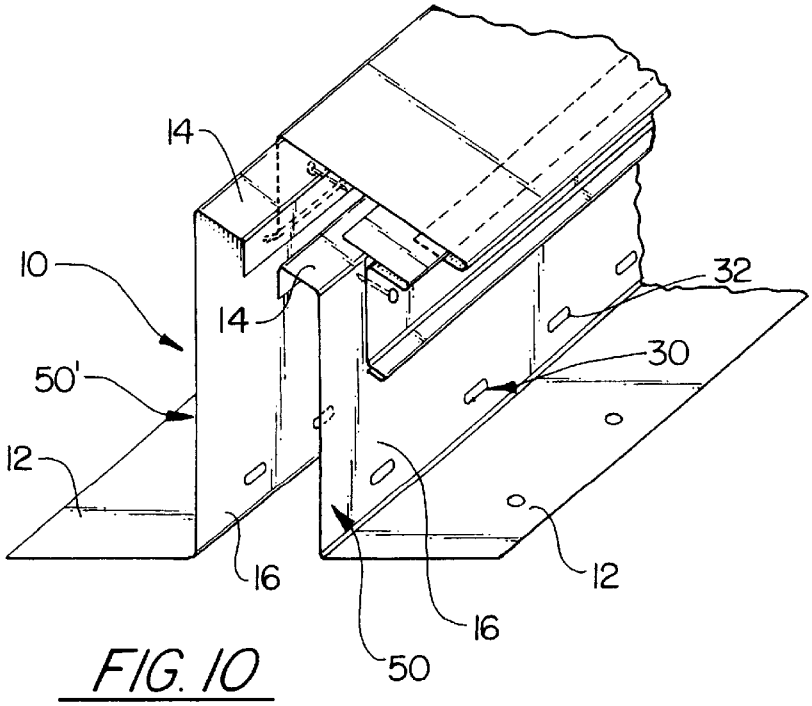
FIG. 10 is an isolated perspective view of another embodiment of the invention showing an expansion joint curb for installation at an expansion joint of a roof system and the attachment of an expansion joint cover thereto.
Figure 11:
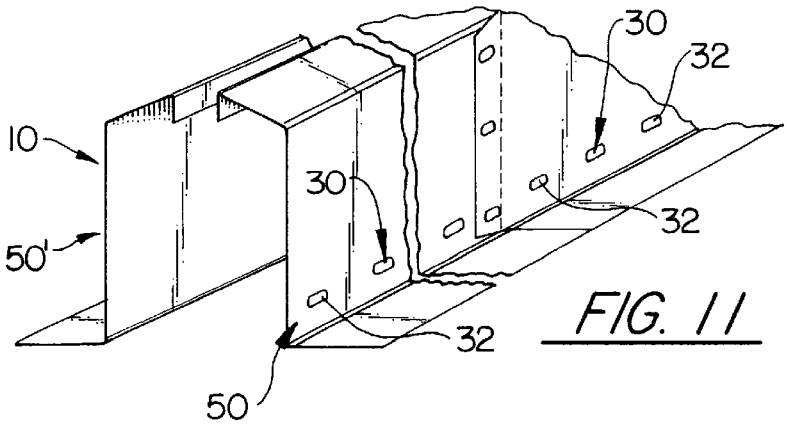
FIG. 11 is a partial perspective view of another embodiment of the expansion joint curb.

FIGS. 10 and 11 illustrate another embodiment of the blocking assembly 10, wherein the blocking assembly embodies an expansion joint curb for installation at an expansion joint on a roof system to facilitate attachment of an expansion joint cover to the expansion joint curb. The expansion joint curb includes two opposing components 50, 50', each comprising the anchoring flange 12, upper flange 14, and intermediate plate portion 16. Vent means 30 in the form of elongate holes or slots are provided in the intermediate plate portion of each of the components, near the anchoring flange.

Figure 12:
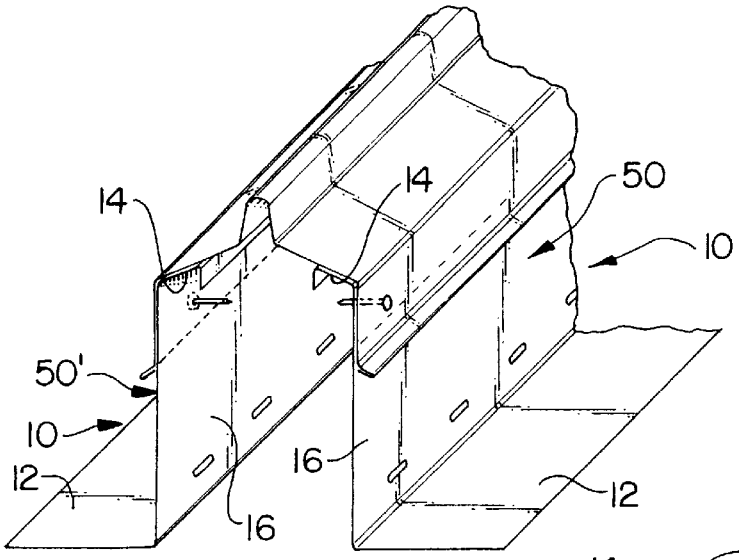
FIG. 12 is a partial perspective view of the expansion joint curb of FIG. 11 as shown with an expansion joint cover attached thereto.
Figure 13:
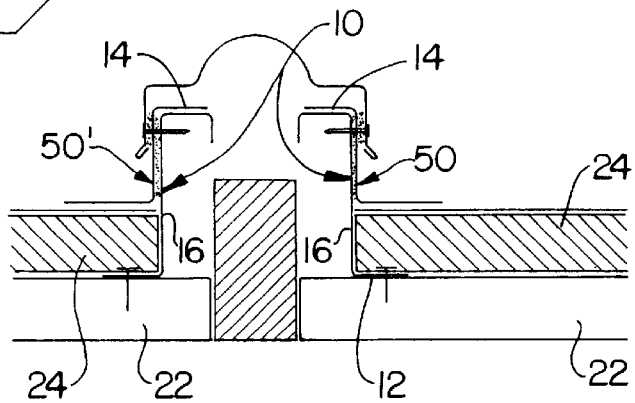
FIG. 13 is a sectional view illustrating another embodiment of the invention comprising a curb type expansion joint having a flat upper flange perpendicular to the intermediate portion.

FIGS. 10, 12 and 13 illustrate various embodiments of the expansion joint curb components 50, 50' positioned in opposing relation to facilitate attachment of an expansion joint cover. As seen in FIG. 13, the anchoring flange is attached to the roof slab, as described above. In these particular embodiments, the upper flange extends outwardly from an opposite face of the intermediate plate portion, creating a generally Z configuration. The area of depth 20 is defined above the anchoring flange, along an outer face of the intermediate plate portion. As seen in FIG. 13, roof insulation material 24 is applied in covering relation to the anchoring flange within the area of depth on the outer face of the intermediate plate portion.

Figure 14:
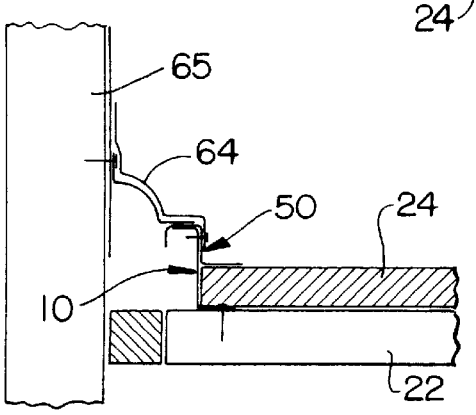
FIG. 14 is a sectional view of the embodiment of FIG. 13 shown used at a wall expansion joint to encapsulate the roof insulation and to facilitate attachment of a wall expansion joint cover.

In FIG. 14, only one of the curb components 50 is used at a wall expansion joint to facilitate attachment of a wall expansion joint cover 64 to the upper flange and intermediate plate portion as well as to a vertical wall structure 65 adjacent the roof slab.

Figure 15:
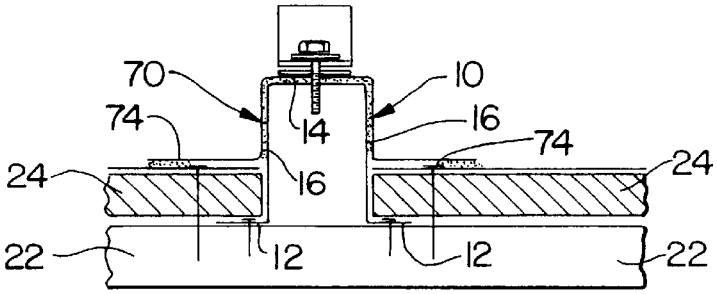
FIG. 15 is a sectional view of another embodiment of the invention for use at a concealed equipment support.

FIG. 15 illustrates yet another embodiment of the blocking assembly 10, shown in the form of a concealed equipment support 70, wherein the blocking assembly 10 comprises a generally inverted U-shape configuration with the upper flange 14 defining the base of the U. The opposing legs of the U are formed by a pair of the intermediate plate portions 16 extending downwardly from the upper flange. Anchoring flanges 12 extend outwardly from the intermediate plate portions for attachment to the roof slab 22. Roof insulation material is installed in overlying relation to the anchoring flange. Additional flange members 74 may be provided, in spaced, parallel relation above the anchoring flange to further facilitate attachment of the equipment's support to the roof structure 22 and to accommodate the insulative material 24 therebetween. Various hardware and equipment can then be mounted to the upper flange 14.

Figure 16:
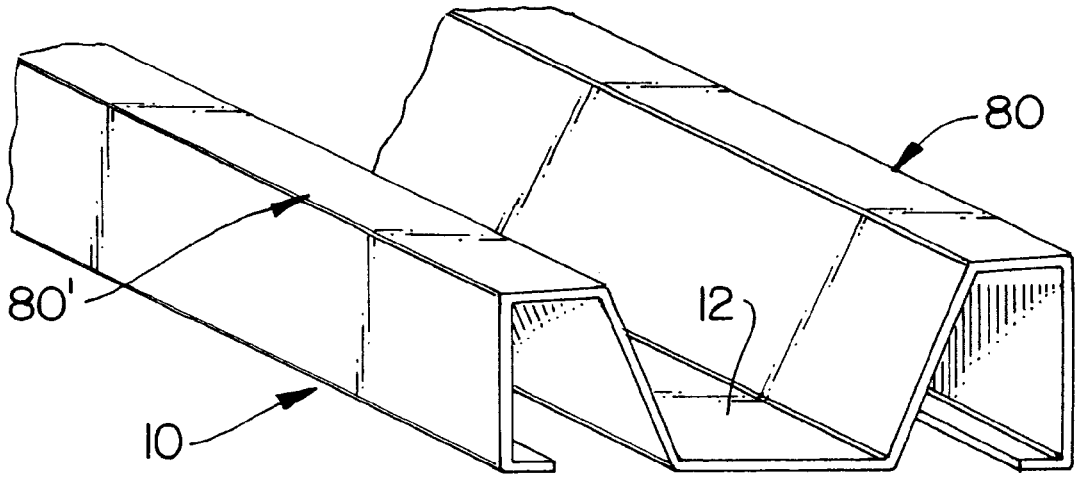
FIG. 16 is a partial perspective view of yet another embodiment of the invention directed to a wall closure.
Figure 17:
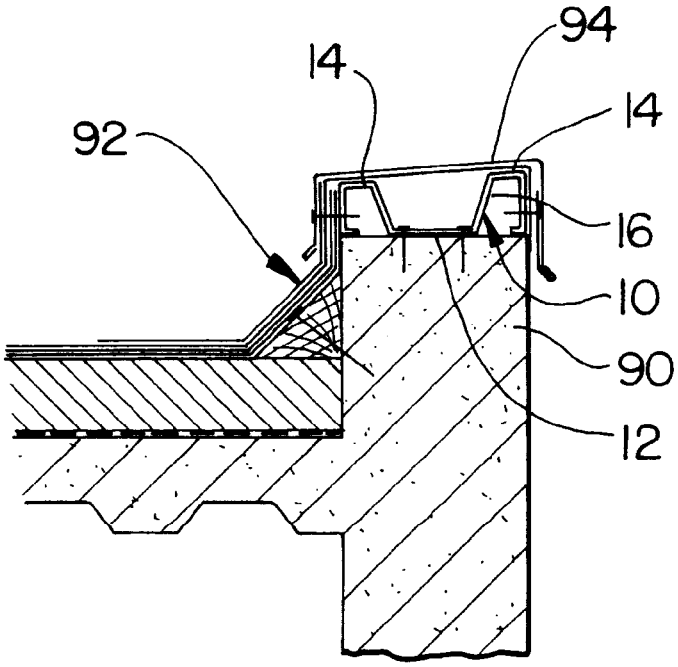
FIG. 17 is a sectional view showing the wall closure of FIG. 16 installed to a concrete parapet on a roof system for attachment of a parapet coping, flashing strip, and steel cleats thereto.

FIGS. 16 and 17 illustrate yet another embodiment of the blocking assembly 10 shown in the form of a wall closure. In this particular embodiment, the wall closure includes a generally M cross-sectional configuration, wherein the anchoring flange 12 is disposed between opposite, parallel portions 80, 80'. The opposite parallel portions include a pair of the intermediate plate portions 16 extending upwardly from the anchoring flange to the upper flange. The upper flange 14 extends outwardly and downwardly on each of the parallel portions 80, 80', as seen in FIGS. 16 and 17. This particular embodiment of the blocking assembly 10 is suited for attachment to the top surface of a concrete parapet 90 to facilitate attachment of various roofing materials including a base flashing strip 92 and parapet coping 94.

It should be noted that in each of the above described embodiments of the blocking assembly 10 of the present invention, the anchoring flange 12, intermediate flange portion 16, and upper flange 14 are preferably formed as an integral unit from galvanized steel, steel, aluminum, plastic or other non-corrosive, durable materials. The integral unit may be formed by various forming and molding methods well known in the industry including bending, roll forming, extrusion molding, injection molding and vacuum molding.

While the instant invention has been shown and described in accordance with preferred and practical embodiments thereof, it is recognized that departures may be made from the instant disclosure which, therefore, should not be limited except as set forth in the following claims as interpreted under the doctrine of equivalents.

What is claimed is:

1. A blocking assembly adapted for the installation of roofing components, materials, insulation materials and equipment on the roof structure of a building said assembly comprising:

an anchoring flange structured and disposed for attachment to the roof structure;

an upper flange defining a mounting base for attachment of the roofing components, materials of equipment thereto, said upper flange extending in parallel, spaced, overlying relation to said anchoring flange to define an area of depth therebetween, and said upper flange and said anchoring flange being adapted for receipt of the insulation materials therebetween;

an intermediate portion including a flat plate extending vertically between said anchoring flange and said upper flange;

vent means formed in said intermediate portion and including a plurality of apertures provided at spaced intervals along said intermediate portion for venting moisture and gases from within said roof structure; and a fascia portion integral with said anchoring flange and extending downwardly therefrom, said fascia portion including means for installing the roofing components thereto.

2. The blocking assembly as recited in claim 1 wherein said plate of said intermediate portion is perpendicular to said anchoring flange.

3. The blocking assembly as recited in claim 2 wherein said anchoring flange and said upper flange extend from said intermediate portion to define an area of depth therebetween to accommodate roof insulation or lightweight concrete.

4. The blocking assembly as recited in claim 3 wherein said anchoring flange, said upper flange and said intermediate portion are formed as an integral unit.

5. The blocking assembly as recited in claim 4 wherein said integral unit is formed of galvanized steel.

6. The blocking assembly as recited in claim 4 wherein said integral unit is formed of steel.

7. The blocking assembly as recited in claim 4 wherein said integral unit is formed of aluminum.

8. The blocking assembly as recited in claim 4 wherein said integral unit is formed of plastic.

9. A blocking assembly adapted for the installation of roofing components, materials, insulation materials, gutters, and equipment of the roof structure of a building said assembly comprising:

an anchoring flange structured and disposed for attachment to the roof structure, said anchoring flange having a flat top surface;

an upper flange defining a mounting base for attachment of the roofing components, materials or equipment thereto, said upper flange extending in parallel, spaced, overlying relation to said anchoring flange to define an area of depth therebetween;

an intermediate portion including a flat plate extending vertically between said anchoring flange and said upper flange;

vent means formed in said intermediate portion and including a plurality apertures provided at spaced intervals along said intermediate portion for venting moisture and gases from within said roof structure; and a fascia portion integral with said anchoring flange and extending downwardly therefrom, said fascia portion including means for installing the gutters along an outer perimeter of the roof structure.

10. The blocking assembly as recited in claim 9 wherein said plate of said intermediate portion is perpendicular to said anchoring flange.

11. The blocking assembly as recited in claim 9 wherein said anchoring flange, said upper flange, and said intermediate portion are formed as an integral unit.

12. The blocking assembly as recited in claim 9 wherein said integral unit is formed of steel.

13. The blocking assembly as recited in claim 9 wherein said integral unit is formed of aluminum.

* * * * *